United States Patent [19]

Graef

[11] 4,314,696

[45] Feb. 9, 1982

[54] PAPER CURRENCY TRANSPORT CONSTRUCTION

[75] Inventor: Harry T. Graef, Dover, Ohio

[73] Assignee: Diebold, Incorporated, Canton, Ohio

[21] Appl. No.: 94,151

[22] Filed: Nov. 15, 1979

[51] Int. Cl.[3] ..... B65H 5/02

[52] U.S. Cl. ..... 271/275; 198/721; 198/957; 271/198

[58] Field of Search ..... 271/275, 272, 273, 274, 271/198, 264, 6, 7; 226/171, 170; 198/721, 725, 957

[56] References Cited

U.S. PATENT DOCUMENTS

| | | | |
|---|---|---|---|
| 3,287,013 | 11/1966 | Fairbanks et al. | 271/272 X |
| 3,331,544 | 7/1967 | Bachman et al. | 226/171 X |
| 3,507,431 | 4/1970 | Hepp et al. | 226/171 X |
| 3,738,642 | 6/1973 | Blaire | 271/10 |
| 3,778,051 | 12/1973 | Allen et al. | 271/263 |
| 3,795,395 | 3/1974 | Ransom et al. | 271/4 |
| 3,874,652 | 4/1975 | Bilbrey | 271/6 X |
| 3,937,453 | 2/1976 | Hickey et al. | 271/4 |
| 4,009,877 | 3/1977 | Ward | 271/272 |
| 4,154,437 | 5/1979 | Butchek et al. | 271/6 |

*Primary Examiner*—Bruce H. Stoner, Jr.
*Attorney, Agent, or Firm*—Frease & Bishop

[57] ABSTRACT

A transport or conveyor mechanism of simple construction and reliable operation for moving paper money bills or currency. Paper money bills are fed from a stack of bills to the transport device and conveyed by the device to a remote delivery point. The transport consists of an endless rubber belt looped around two rolls one of which is driven. One belt flight is sandwiched between two coextensive metal plates having smooth surfaces coated with low friction material. A belt surface engages bills fed to it at the transport entry end, against one of the smooth plate surfaces under pressure of the other plate, and moves the bills to the discharge or delivery end of the transport device.

13 Claims, 7 Drawing Figures

PAPER CURRENCY TRANSPORT CONSTRUCTION

BACKGROUND OF THE INVENTION

1. Field of the Invention

The invention relates to a transport or conveyor mechanism for moving paper money currency one bill at a time from a supply stack of paper money bills to a delivery area. More particularly the invention relates to a transport mechanism which may move new or limp, used, old or a mixed combination of new or old paper money bills fed by a picker from a supply stack of bills in a currency dispenser to a customer at a delivery location.

More particularly, the invention involves a very low-cost transport mechanism which has a simplified construction that is extremely reliable in operation, comprising very few components without costly gear-driven pairs of conveyor rolls and which components include a flat longitudinally and laterally continuous endless rubber belt trained around a pair of spaced rolls one of which is driven to drive the belt in a desired direction, the belt having one flight engaged under pressure sandwiched in a space between a rigid flat coated metal pressure or backup plate and a rigid flat coated metal platform plate or platen, whereby paper money bills may be conveyed for long distances by the driven belt along the platform plate.

2. Description of the Prior Art

Prior art devices for conveying paper money bills from one point to another have included many types of construction, such as opposed roll conveyors, opposed double belt conveyors, and chain-pusher conveyors. All such conveyors have relatively complicated construction and operation features which are costly to manufacture and maintain.

One example of a double belt device is shown in Blaire et al. U.S. Pat. No. 3,738,642 wherein opposed belts convey paper money from a stack between opposed corrugated belt formations, which impart corrugations or crinkles in the bills to provide bill separation.

Another example of double belt bill transport construction is shown in Hickey et al. U.S. Pat. No. 3,937,453 wherein the complicated transport construction and arrangement is self-evident.

Still another device for handling sheets by transport means is shown in Allen et al. U.S. Pat. No. 3,778,051 wherein sheets are fed from a stack to the underside of a lower belt flight of an endless belt looped around a pair of spaced rolls and are held to the belt by a suction device while a sensor senses the sheet thickness to signal the presence of multiple sheets.

Another known conveyor construction for feeding paper money bills from the bottom of a stack of bills along a path that extends in three different directions to a delivery area is shown in Ransom et al. U.S. Pat. No. 3,795,395 wherein a pair of narrow-spaced belts move against a series of spaced static plates having various irregular shapes. Laterally spaced corner rolls are located at the spaces between plates and the spaced narrow belts are guided around the corners by the spaced rolls which the belts contact directly. The spaced belts are intermittently pressed against the plates by spring-loaded idler rolls. The paper money bills thus conveyed are not engaged throughout the entire bill area at all times under pressure by the belts because of belt spacing, plate spacing, and spaced idler rolls. This can reult in irregular drive of the bills so that the bills may twist or skew or wrinkle.

Such known prior art transport devices are undesirable for one reason or another, particularly in automatic bank equipment cash dispensers, because of their complicated constructional characteristics or the expense involved in manufacture and maintenance thereof. Also jamming of bills may occur in the operation of some of the prior devices. Finally, old or used limp paper money presents special problems in cash dispensers.

There has been an unsatisfied want in the art of paper money bill conveyors and particularly those used in the automatic cash dispenser field for a transport mechanism which is simple in construction, which requires little if any maintenance, which is very reliable and effective in operation, which is capable of handling both new and old, limp, used paper money bills, which consists of very few simple components, which has a substantially lower cost than known prior devices, which minimizes jamming, and which readily conveys bills for long distances.

SUMMARY OF THE INVENTION

Objectives of the invention include providing a transport mechanism for paper money bills which has a simplified construction of very few components capable of conveying paper money bills for long distances without the necessity of costly gear-driven multiple pairs of conveyor rolls; providing such transport mechanism composed of a minimum number of low-cost components which operate effectively to avoid jamming, crinkling, wrinkling, twisting or skewing of paper money bills, particularly limp used bills, fed to the transport mechanism from a stack of bills for delivery to a customer using automatic banking equipment which include currency dispensers; providing such a transport mechanism in which the paper money bills are each positively frictionally engaged by a preferably textured surface of a tensioned flat portion of a rubber belt driven to move the bills slidably along a smooth flat coated surface of a metal platen substantially free of friction, herein termed a "low friction" surface, between the paper money bills and the platen surface; providing such a transport mechanism in which the bill engaging portion of the tensioned rubber belt is held under pressure during belt movement by a flat metal pressure plate located spaced from the platen with the moving belt sandwiched therebetween; providing such transport mechanism which can efficiently and reliably convey paper money bills, one at a time, regardless of bill dimension and whether the bills are new or limp, used, old money or a random mixture thereof; and providing a new transport mechanism which achieves the stated objectives in a reliable, efficient, easily driven and controlled manner, and which solves problems and satisfies needs that long have existed in the field of currency dispensers for automatic banking equipment.

These and other objectives and advantages may be obtained with the new transport mechanism, the general nature of which may be stated as including a pair of spaced belt conveyor rolls having longitudinal axes, a flat longitudinally and laterally continuous endless rubber belt looped and tensioned around said conveyor rolls and having inner and outer surfaces, means operatively connected with at least one of said rolls to rotate such one roll to move the belt, a rigid flat platen, a rigid flat backup plate spaced from and parallel with said platen, said platen and backup plate extending between the rolls and being wider than the belt and also being parallel with the axes of said spaced rolls, the surfaces of said spaced platen and backup plate facing each other which define the space therebetween each having a low friction surface, one flight of the belt being located in the space between the platen and backup plate with the low friction backup plate surface engaging the inner belt surface and the low friction platen surface engaging the outer belt surface, and said one flight of the belt being movable between the rolls pressed by the backup plate against the platen substantially throughout the space between the rolls.

BRIEF DESCRIPTION OF THE DRAWINGS

Preferred embodiments of the invention—illustrative of the best mode in which applicant has contemplated applying the principles—are set forth in the following description and shown in the drawings and are particularly and distinctly pointed out and set forth in the appended claims.

Similar numerals refer to similar parts throughout the various figures of the drawings.

DESCRIPTION OF THE PREFERRED EMBODIMENTS

First Embodiment

Figure 1:
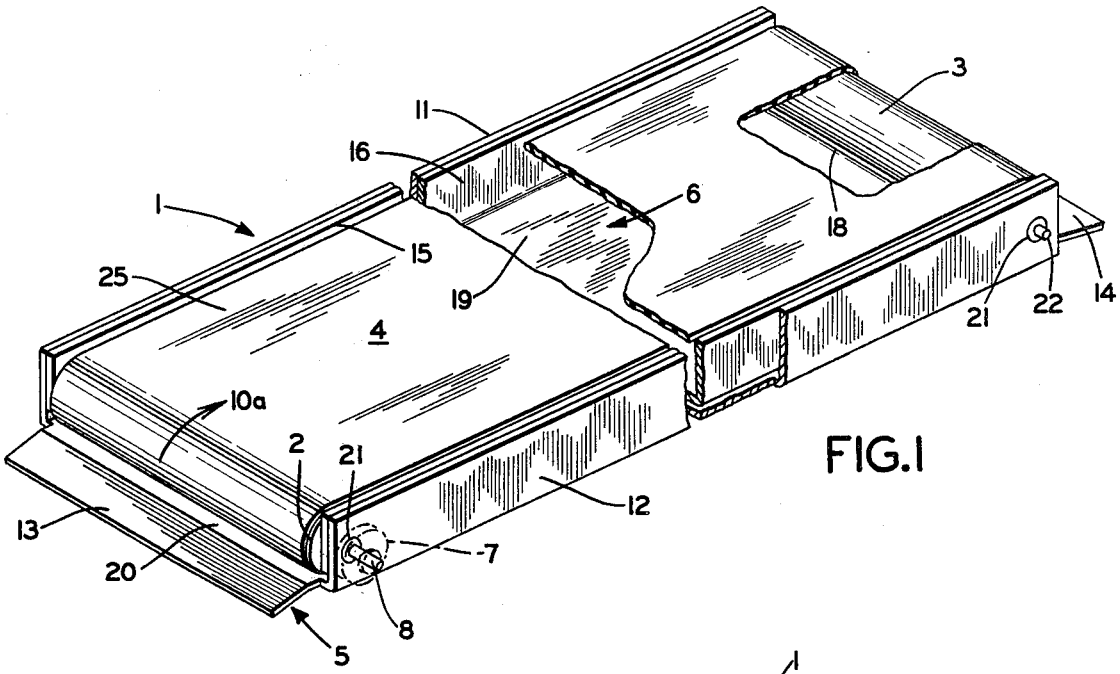
FIG. 1 is a diagrammatic perspective view of the essential components of the new transport mechanism.
Figure 2:
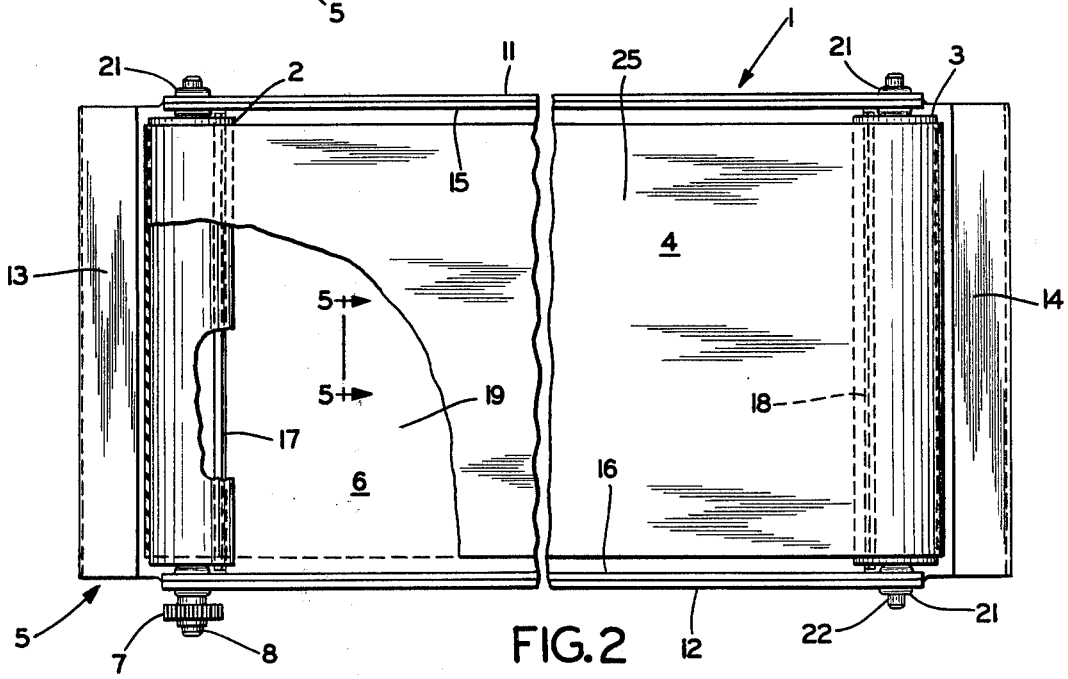
FIG. 2 is an enlarged plan view, with parts broken away, somewhat diagrammatically showing the transport mechanism shown in FIG. 1.

One type of improved paper money bill transport mechanism is shown in FIGS. 1 through 6, the transport or conveyor being indicated generally at 1. The simple, low-cost, few-in-number components of transport 1 include a pair of spaced belt tensioning, support and drive rolls 2 and 3 around which the endless belt 4 is trained, a platen 5, and a pressure or backup plate 6. One of the rolls, such as roll 2, may be driven in a desired direction by a gear 7 on the roll shaft 8 for roll 2. A pinion 9 engages the gear 7, driven by a motor (not shown). Roll 2 may rotate clockwise and, thus, the belt 4 moves in the direction indicated by arrows 10 and 10*a*.

The platen 5 is a rigid flat metal plate preferably formed of aluminum. At least the aluminum plate surface 20, the top surface of platen 5 as shown in FIG. 3, is coated with polyphenylene sulfide to form a low friction surface on the platen 5 along which paper money bills are easily moved in operation of the transport 1 described more in detail below.

The lateral edges of the platen 5 are formed with flanges 11 and 12 which project at right angles away from the coated surface 20 of the platen; and the ends of the platen 5 are formed with angular ramps 13 and 14. Thus, the platen 5 is channel-like in cross section as shown in FIG. 4.

Figure 3:
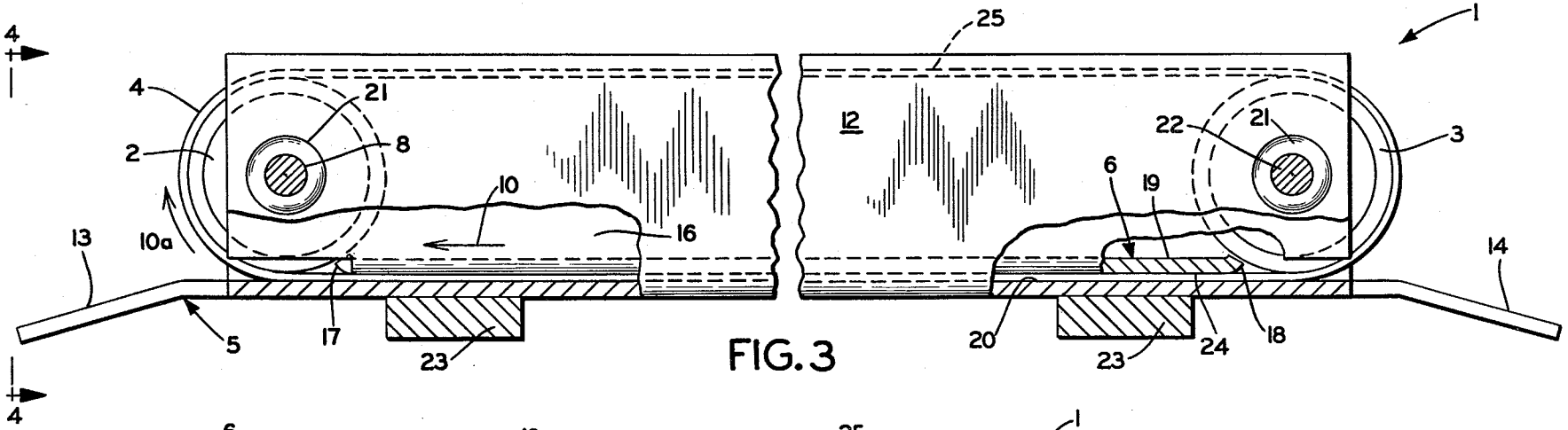
FIG. 3 is a further enlarged side elevation, with parts broken away and in section, looking in the direction of the arrows 3—3, FIG. 4.
Figure 4:
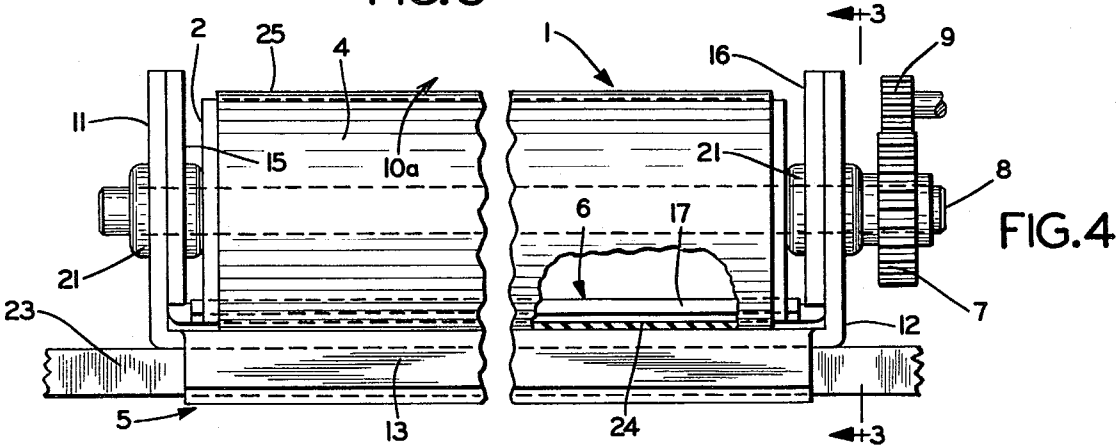
FIG. 4 is an end view of the new construction looking in the direction of arrows 4—4, FIG. 3.

The rigid flat metal pressure or backup plate 6 is similar to platen 5 having right-angularly projecting flanges 15 and 16 at its side edges and slightly curved end edges 17 and 18 as shown in FIGS. 3 and 4. Thus, backup plate 6 also is channel-shaped in cross section and may be nested within the flanges 11 and 12 of the platen 5 with the flat rigid channel web portion 19 parallel to and spaced from the coated surface 20 of platen 5.

The channel flanges of the platen 5 or backup plate 6 provide a simple way of assembling the rolls 2 and 3 in fixed positions at the ends of the transport 1, as well as providing a support for the platen and backup plate with the desired spacing therebetween. When the desired spacing between the platen and pressure plate is to be fixed, and not adjustable, the flanges of the nested channel-shaped platen 5 and backup plate 6 may be secured together in any suitable manner, and the flanges 12, 13, 15 and 16 are provided preferably with bushings or bearings 21 in which the shaft 8 of belt roll 2 and the shaft 22 of belt roll 3 are journaled as shown in FIGS. 3 and 4. If some adjustability of the platen spacing with respect to the pressure plate is desired, for example, to accommodate different belt thicknesses or platen flatness tolerances over long platen lengths, such adjustability may be provided with a slightly slotted support of the roll shafts with respect to the flanges of one of the platen 5 or pressure plate 6 components.

The belt drive gear 7 may be fixed to one end of the shaft 8 outside of one of the bearings 21 as shown in FIG. 4. The assembly of belt rolls 2 and 3, belt 4, platen 5 and backup plate 6 may be supported in any desired manner on a base, at any desired location with respect to other components of currency dispensing equipment. Such base is diagrammatically represented by support members 23.

The backup plate 6, similar to the platen 5 also preferably is formed of aluminum and at least the backup plate surface 24 opposed to and spaced from the platen surface 20 also is coated with polyphenylene sulfide.

The axes of the belt roll shafts 8 and 22 are parallel with the platen surface 20 and are mounted as described a fixed distance above the platen surface 20. As indicated, the channel web portion 19 of the backup plate 6 is spaced from the coated platen surface 20. This space between the coated platen and backup plate surfaces 20 and 24 is preferably approximately the same as the thickness of the belt 4 so that the backup plate 6 presses the belt against the platen 5. The coatings on the surfaces 20 and 24 provide low friction surfaces on the platen and backup plate permitting the belt when driven and moved in the direction of the arrows 10 and 10*a* to move with ease despite the fact that the rubber belt has friction surfaces characteristic of rubber articles. Further, the outer surface of the belt indicated generally at 25, which contacts the coated platen surface 20 is preferably textured or somewhat roughened to the desired degree so as to increase the friction characteristics thereof.

Although neoprene is a suitable material for forming the belt 3, I have found that a textured "Hypalon" belt material which is a product of the DuPont Company formed of synthetic rubber that is resistant to oil, ozone and other chemicals, is most satisfactory.

Although metals other than aluminum such as stainless steel may be used which can be coated with coating materials providing low friction surfaces, it is most desirable to form the platen 5 and backup plate 6 from aluminum coated with polyphenylene sulfide which is a product of de-Beers Laboratories, Inc., 111 South Fairbank Street, Addison, Ill., identified as "Debron" No. 711, Code-Non-Stick PPS/PTFE Coating. Such coated aluminum plate is desirable because it may be used in coated condition as a raw material that may be readily formed to the channel shapes which characterize the platen 5 and backup plate 6 without cracking, flaking or otherwise disturbing the non-stick low friction coatings on the surfaces along which the belt moves easily.

Alternatively the platen 5 and backup plate 6 may be made of polyphenylene sulfide to provide low friction surfaces between which the belt moves.

I have discovered also that it is possible to readily convey paper money bills, regardless of bill length or width dimensions (paper money in various countries has different sizes), whether the bills are new or old limp, used bills, from the entry of the transport mechanism 1 beneath belt roll 3 to the exit of the transport mechanism, at the left of the belt roll 2 in FIG. 3, without bill wrinkling, jamming, skewing, etc.

The friction or textured surface 25 of the belt frictionally engages each paper money bill throughout the entire surface of the bill contacted by the belt in moving the bill. During movement the pressure plate 6 presses the plate 4 against the bill and platen. Because the opposed coated surfaces 24 and 20 of the pressure plate and platen have as low friction characteristics as possible, the belt moves the frictionally engaged bills along the platen in the direction of the arrow 10.

Referring to FIG. 3, the ramps 13 and 14 project beyond the ends of the flat platen portion and beyond the ends of the platen flanges 11 and 12. On the other hand, the flat web portion 19 of the backup plate 6 terminates at the slightly curved ends 17 and 18 short of the ends of the backup plate flanges 15 and 16. The curved backup plate end edges 17 and 18 are curved so as to prevent catching or scraping of the belt against a sharp metal edge.

The belt, backup plate and platen widths and the length of the belt rolls 2 and 3 are such that the largest lateral width of paper money bills to be transported can be accommodated. Engagement of a bill by the belt under pressure from the pressure plate throughout the length of the pressure plate between the belt rolls assures bill movement without wrinkling, etc.

The length of the transport mechanism 1 is not critical, its length being such as to extend between a desired location of entry and exit ends of a transport. The presence of the backup plate 6 pressing the belt into contact with the platen 5 throughout the space between the rolls 2 and 3 provides the necessary belt contact with bills being conveyed throughout the length of the transport mechanism 1. Further, belt speed is not critical, as the new construction of the invention will convey any kind of paper money bills, limp or new, at any desired speed.

Figure 6:
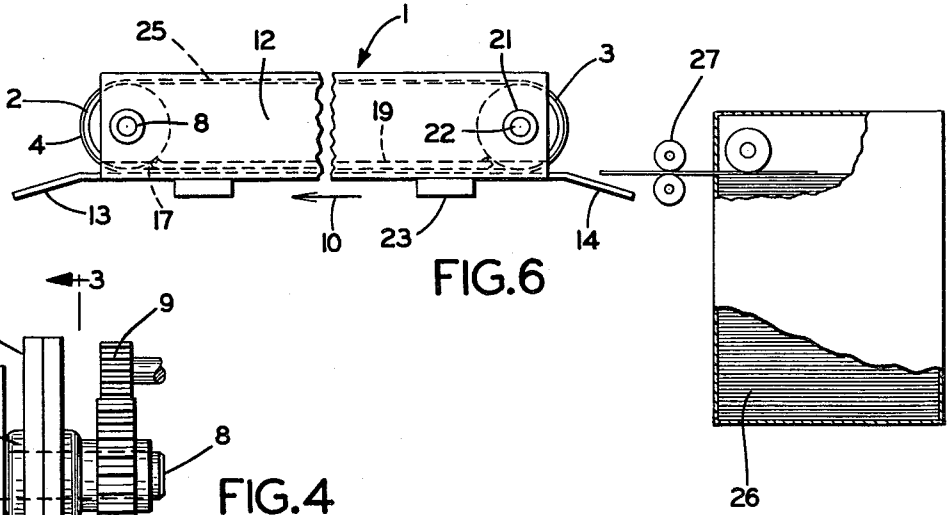
FIG. 6 is a view on a smaller scale similar to FIG. 3 showing paper money bills being fed from a stack of bills to the improved transport mechanism.
Figure 5:
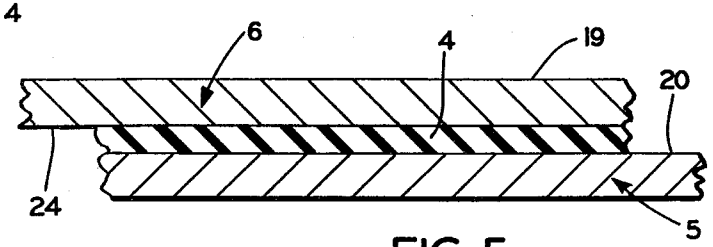
FIG. 5 is a fragmentary sectional view taken on the line 5—5, FIG. 2.

FIG. 6 illustrates the operation and use of the transport device 1. The transport device may be located adjacent a stack of paper money bills diagrammatically illustrated generally at 26. Bills are fed one at a time from the stack 26 by feed means 27 to the entry ramp 14 of the transport mechanism 1 where the leading edge of each bill is engaged by the belt beneath the belt roll 3. The bill then is conveyed to the exit end of the transport mechanism where delivery is desired.

Second Embodiment

Figure 7:
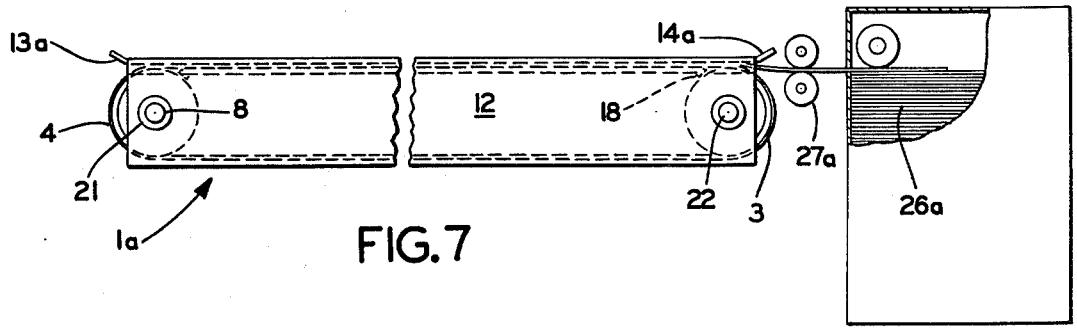
FIG. 7 is a view similar to FIG. 6 showing a modified form of construction.

It is not necessary for the platen to be located below the endless belt for carrying out a transport operation. As shown in FIG. 7, the transport device of FIG. 6 may be turned upside down as indicated at 1*a* and provided with shorter ramps 14*a* and 13*a* with otherwise the same construction as illustrated in FIGS. 1 through 6. Such a transport 1*a* may be located adjacent a stack of bills 26*a* from which bills are fed one at a time by feed means 27*a* to the transport mechanism 1*a* beneath the entry ramp 14*a*.

Accordingly, the present invention provides a very low-cost transport construction which has very few components of simple design which when assembled may reliably convey paper money bills of various types and sizes, old or new, from one location to another without costly gear-driven pairs of conveyor rolls by a simple continuous endless rubber belt looped around a pair of spaced rolls one of which may be driven to move the belt with the belt having one friction surface engaged with the bills under pressure between rigid flat low friction surfaces of spaced metal plates between which the belt engaging the bills is moved; and thus provides a new construction incorporating the stated objectives and solving problems and satisfying needs that have existed in the art.

In the foregoing description, certain terms have been used for brevity, clearness and understanding; but no unnecessary limitations are to be implied beyond the requirements of the prior art because such terms are used for descriptive purposes and are intended to be broadly construed.

Thus the term "low friction", as used in the Specification and Claims with respect to coated metal surfaces, are intended to describe a surface having reduced friction characteristics of the most reasonable possible degree.

Moreover, the description and illustration of the invention is by way of example, and the scope of the invention is not limited to the exact details shown or described.

Having now described the features, discoveries, and principles of the invention, the manner in which the new transport is constructed and operated, and the advantageous, new and useful results obtained; the new and useful structures, devices, components, elements, arrangements, parts, combinations, operations, procedures, and relationships are set forth in the appended claims.

I claim:

1. Transport mechanism for conveying paper money bills from place to place in automatic banking equipment currency dispensers including:

(a) a pair of spaced belt conveyor rolls having longitudinal axes, (b) a flat longitudinally and laterally continuous endless rubber belt looped and tensioned around said conveyor rolls and having inner and outer surfaces, (c) means operatively connected with at least one of said rolls to rotate such one roll to move the belt, (d) a rigid flat platen, (e) a rigid flat backup plate spaced from and parallel with said platen, (f) said platen and backup plate extending between the rolls and being wider than the belt and also being parallel with the axes of said spaced rolls, (g) the surfaces of said spaced platen and backup plate facing each other which define the space therebetween each having a low friction characteristic, (h) one flight of the belt being located in the space between the platen and backup plate with the low friction backup plate surface engaging the inner belt surface and the low friction platen surface engaging the outer belt surface, and (i) said one flight of the belt being movable between the rolls pressed by the backup plate against the platen substantially throughout the space between the rolls.

2. The transport mechanism as defined in claim 1 in which the belt has a textured outer surface and is formed of "Hypalon" material.

3. The transport mechanism as defined in claim 1 in which the platen and backup plate each are formed of aluminum.

4. The transport mechanism as defined in claim 3 in which the low friction surfaces of the aluminum platen and backup plate are coated with "Debron No. 711".

5. The transport mechanism as defined in claim 4 in which the belt has a textured outer surface and is formed of "Hypalon" material.

6. The transport mechanism as defined in claim 1 in which the platen and backup plate each are formed of polyphenylene sulfide.

7. The transport mechanism as defined in claim 1 in which the belt is a broad flat belt having at least a textured outer surface and is movable in one direction upon rotation of said one roll.

8. The transport mechanism as defined in claim 7 in which the rigid flat platen and rigid flat backup plate are mounted a fixed distance apart to define the space therebetween.

9. The transport mechanism as defined in claim 1 in which one of the conveyor roll shafts is provided with a pinion, and in which gear drive means engages the pinion to move the belt in its path of travel.

10. The transport mechanism as defined in claim 1 in which the belt is laterally wider than the maximum dimension of paper money bills intended to be transported by the transport mechanism, and in which either new or old—limp—used or randomly arranged new and old paper money bills having various dimensions may be transported one bill at a time by the transport mechanism.

11. The transport mechanism defined in claim 1 in which the platen and backup plate each are formed with longitudinally extending side edge flanges forming a channel shape in cross section, in which the backup plate flanges are nested within the platen flanges, and in which the conveyor rolls have roll shafts the ends of which are journaled at spaced locations in said nested flanges adjacent the longitudinal ends of said nested flanges.

12. The transport mechanism as defined in claim 11 in which the platen has a web portion between its flanges which is provided with angular ramps at its longitudinal ends extending beyond the ends of the nested flanges.

13. The transport mechanism as defined in claim 12 in which the backup plate has a web portion between its flanges which terminates adjacent the rolls in curved end edges short of the ends of the nested flanges.

* * * * *